US006179384B1

(12) United States Patent
DeKraker et al.

(10) Patent No.: US 6,179,384 B1
(45) Date of Patent: Jan. 30, 2001

(54) FORCE ADJUSTING DEVICE

(75) Inventors: Larry DeKraker, Holland; Kurt R. Heidmann, Grand Rapids, both of MI (US)

(73) Assignee: Steelcase Development Inc., Grand Rapids, MI (US)

( * ) Notice: Under 35 U.S.C. 154(b), the term of this patent shall be extended for 0 days.

(21) Appl. No.: 09/296,004

(22) Filed: Apr. 21, 1999

(51) Int. Cl.[7] ..... A47C 3/025
(52) U.S. Cl. ..... 297/284.4; 297/284.1
(58) Field of Search ..... 192/30 R, 95, 192/202; 74/491, 504, 543, 553; 297/463.1, 362, 354.12, 284.1, 284.4

(56) References Cited

U.S. PATENT DOCUMENTS

| | | | |
|---|---|---|---|
| 3,110,380 | | 11/1963 | Meyer et al. . |
| 3,926,474 | | 12/1975 | Johndrow et al. . |
| 3,929,374 | | 12/1975 | Hogan et al. . |
| 3,982,785 | | 9/1976 | Ambasz . |
| 4,181,357 | | 1/1980 | Swenson et al. . |
| 4,531,779 | | 7/1985 | Hashimoto . |
| 4,641,884 | | 2/1987 | Miyashita et al. . |
| 4,696,382 | * | 9/1987 | Aho . |
| 4,735,518 | * | 4/1988 | Burgin . |
| 4,840,080 | | 6/1989 | Kobayashi et al. . |
| 4,880,271 | | 11/1989 | Graves . |
| 4,896,918 | | 1/1990 | Hoshihara . |
| 4,968,093 | | 11/1990 | Dal Monte . |
| 5,050,930 | | 9/1991 | Schuster et al. . |
| 5,127,286 | * | 7/1992 | Wittig . |
| 5,197,780 | | 3/1993 | Coughlin . |
| 5,217,278 | | 6/1993 | Harrison et al. . |
| 5,249,839 | | 10/1993 | Faiks et al. . |
| 5,299,851 | | 4/1994 | Lin . |
| 5,423,593 | | 6/1995 | Nagashima . |
| 5,462,335 | | 10/1995 | Seyler . |
| 5,476,306 | | 12/1995 | Golynsky . |
| 5,505,520 | | 4/1996 | Frusti et al. . |
| 5,516,198 | | 5/1996 | Yokoyama . |
| 5,518,294 | | 5/1996 | Ligon, Sr. et al. . |
| 5,522,489 | | 6/1996 | Savkar et al. . |
| 5,553,922 | | 9/1996 | Yamada . |
| 5,704,687 | | 1/1998 | Klingler . |
| 5,871,258 | | 2/1999 | Battey et al. . |

* cited by examiner

*Primary Examiner*—Milton Nelson, Jr.
(74) *Attorney, Agent, or Firm*—Price Heneveld Cooper Dewitt & Litton

(57) ABSTRACT

A chair includes a back frame and a flexible back support operably supported on the back frame. The flexible back support includes a flexible lumbar region and a flanged bracket pivotally connected to the back frame at a back support pivot. A force adjusting device is attached to the back frame at the back support pivot for adjusting a torsional spring-generated biasing force on the flanged bracket relative to the back frame. The force adjusting device includes a housing, a base attached to the housing, a spring operably mounted in the housing, and a gear arrangement operably connected to a cup-shaped handle to biasingly adjust a position of the spring with mechanical advantage to adjust a tension of the spring. A clutch is operably attached between the gear arrangement and the handle. The clutch is constructed to lock when a biasing force is received from the back support, but is configured to release and allow movement of the handle and the gear arrangement to adjust a tension of the spring when the handle is moved.

27 Claims, 5 Drawing Sheets

FORCE ADJUSTING DEVICE

BACKGROUND OF THE INVENTION

The present invention relates to force adjusting devices, and more particularly relates to a force adjusting device that is easily adjustable to vary a biasing force, but that locks after adjustment to maintain an adjusted biasing force. Further, the present invention concerns a chair that incorporates the force adjusting device into an adjustable lumbar support arrangement on a back of the chair.

Force adjusting devices are sometimes used in mechanical assemblies to provide a biasing force to accomplish a desired result. A problem is that where significant biasing force is desired, these mechanisms can become expensive, unacceptably large in size, and unacceptably complex. Complexity can further result in quality and warranty problems. Another problem is that there often are conflicting requirements for such devices. For example, it is desirable to provide an adjusting motion that is easily accomplished, but that provides significant change in biasing force with only a small amount of adjustment effort and motion. Further, when used in retail consumer products, the adjusting motion must preferably operate smoothly and provide a luxurious feel to the user, while using low cost and easily assembled components. It is difficult to simultaneously achieve such a result. Still further, the adjusting motion must be intuitively obvious so that users will know how to adjust the device without having to read an instruction manual, yet the adjusting device must have an aesthetically acceptable appearance and only take up a minimum of space. Also, assembly of the force adjusting device to the component being biased preferably must be easily accomplished with low labor requirements.

Accordingly, a force adjusting device is desired that is reliable, relatively non-complex, solves the aforementioned problems, and has the aforementioned advantages.

SUMMARY OF THE INVENTION

In one aspect of the present invention, a force adjusting device is provided for adjusting a spring-generated biasing force on a movable component relative to a second component. The force adjusting device includes a housing adapted for attachment to the second component and a spring operably mounted to the housing. The spring has a first end adapted to engage the movable component and has a second end. A force multiplier arrangement operably engages the second end and is configured to change a position of the second end with mechanical advantage to adjust a tension of the spring. A handle is provided for operating the force multiplier arrangement, and a clutch is operably attached to the force multiplier arrangement and the handle. The clutch is constructed to lock when a biasing force is received from the spring, but is configured to release and allow movement of the handle and the force multiplier arrangement to adjust a tension of the spring when the handle is manipulated.

In another aspect of the present invention, a force adjusting device includes a housing adapted for attachment to the second component, and a spring operably mounted to the housing. The spring has a first end adapted to engage the movable component and has a second end. A hub engages the second end and is configured to change a position of the second end to adjust a tension of the spring. A handle is provided for rotating the hub. A clutch is operably attached to the hub and the handle. The clutch is constructed to lock when a biasing force is received from the movable component, but is configured to release and allow movement of the handle and the hub to adjust a tension of the spring when the handle is manipulated.

In another aspect of the present invention, a force adjusting device includes a housing adapted for attachment to the second component, and a spring operably mounted to the housing. The housing includes an internal tooth ring gear. The spring has a first end adapted to engage the movable component and has a second end. A gear arrangement engages the second end and the ring gear and is configured to change a position of the second end with mechanical advantage to adjust a tension of the spring. A handle is operably attached to the gear arrangement for operating the gear arrangement. By this arrangement, the handle can be manipulated to operate the gear arrangement to adjust a tension of the spring.

In yet another aspect of the present invention, a chair includes a back frame and a flexible back support operably supported on the back frame. The flexible back support includes a flexible lumbar region and a flanged bracket pivotally connected to the back frame at a back pivot. A force adjusting device is attached to the back frame at the back pivot for adjusting a spring-generated torsional biasing force on the flanged bracket relative to the back frame. The force adjusting device includes a housing adapted for attachment to the back frame, a spring operably mounted to the housing, and a gear arrangement. The housing includes an internal tooth ring gear. The spring has a first end constructed to engage the flanged bracket and has a second end and is adapted to generate the torsional biasing force. The gear arrangement engages the second end and the ring gear, and is configured to change a position of the second end with mechanical advantage to adjust a tension of the spring. A handle is provided for operating the gear arrangement, and a clutch arrangement is operably attached to the gear arrangement and the handle. The clutch is constructed to lock when a biasing force is received from the back support, but is configured to release and allow movement of the handle and the gear arrangement to adjust a tension of the spring when the handle is manipulated.

In still another aspect of the present invention, a furniture unit includes a first structural component, a second structural component movably attached to the first structural component, and a force adjusting device including a biasing member biasing the second structural component relative to the first structural component, an adjuster configured to adjust the biasing member, and a clutch. The adjuster includes a force multiplier to reduce a force required to move the adjuster. The clutch is configured to release the adjuster to permit adjustment when operated by an operator, but is configured to lock the biasing member in a selected position when an operator is not operating the adjuster.

These and other features, objects, and advantages of the present invention will become apparent to a person of ordinary skill upon reading the following description and claims together with reference to the accompanying drawings.

DETAILED DESCRIPTION OF PREFERRED EMBODIMENT

Figure 1:
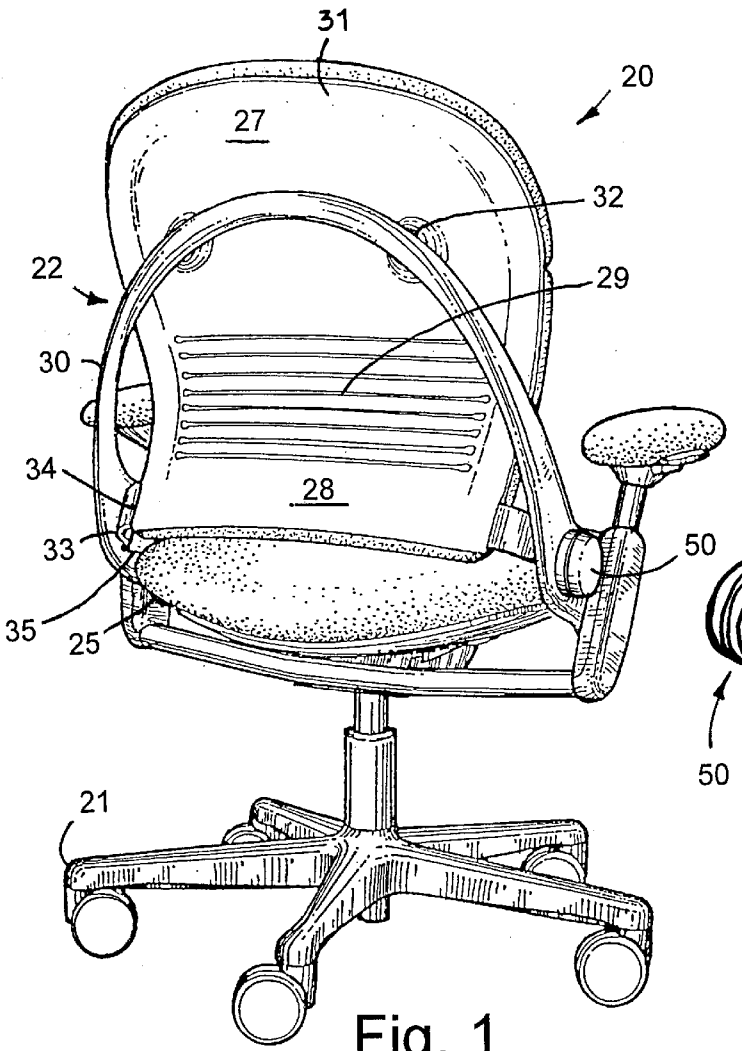
FIG. 1 is a rear perspective view of a chair including a force adjusting device embodying the present invention.

A force adjusting device 50 (FIG. 1) embodying the present invention is shown in a lumbar biasing device on a chair 20. The chair 20 includes a base 21 and a reclineable back 22 pivoted to the base 21. The back 22 includes a back frame 30 pivoted at pivot 25, and a flexible back shell 31 pivoted to the back frame 30 at top pivots 32 and at a bottom pivot 33. The back shell 31 has relatively stiff thoracic and pelvic sections 27 and 28, but a relatively flexible lumbar section 29 connecting the thoracic and pelvic sections 27 and 28. Despite the flexibility of lumbar section 29, the back shell 31 comprises a sheet that is relatively stiff along a surface or "plane" of the back shell 31. The lumbar section 29 protrudes forwardly to define a forwardly concave shape in its at-rest position in the chair 20. A belt bracket 34 is attached along a bottom of the back shell 31. The belt bracket 34 has forwardly extending flanges 35 that include the bottom pivot 33. The combination of the belt bracket 34 with flanges 35, the flexible lumbar section 29, and the stiff thoracic and pelvic sections 27 and 28 cause the back shell 31 to flex along a predetermined path as the pelvic section 28 rotates about bottom pivot 33. The force adjusting device 50 is mounted at pivot 33 to back frame 30 and is configured to rotationally bias the flange 35 of belt bracket 34, so that the lumbar section 29 is biased forwardly to posturally and comfortably support a seated user's lower back. The force adjusting device 50 provides an adjustable biasing force on the back shell 31 that provides optimal, yet adjustable, lumbar support to a seated user.

The above description of chair 20 is believed to be sufficient for an understanding of the present combination that includes the novel force adjusting device 50. Nonetheless, a more detailed description of the chair 20, and in particular of the back shell 31 and its flexible lumbar region, can be found in U.S. Pat. No. 5,871,258, issued Feb. 16, 1999, entitled *Chair with Novel Seat Construction*, and also in U.S. patent application Ser. No. 08/957,473, filed Oct. 24, 1997, entitled *Chair Including Novel Back Construction*, the entire contents of which are incorporated herein in their entirety by reference. It is to be understood that a scope of the present invention includes using the force adjusting device 50 in combination with an adjustable force lumbar support arrangement as shown in the illustrated chair, but it is also to be understood that the present invention includes other uses of the force adjusting device 50. For example, the force adjusting device can be used in other applications on a chair requiring force adjustment, or in other non-chair type furniture, such as desks, cabinets, and tables requiring an adjustable biasing device, or even in non-furniture situations, where a first component must be adjustably biased relative to a second component with an easily adjustable but a secure and well-packaged force adjusting device.

Figure 3:
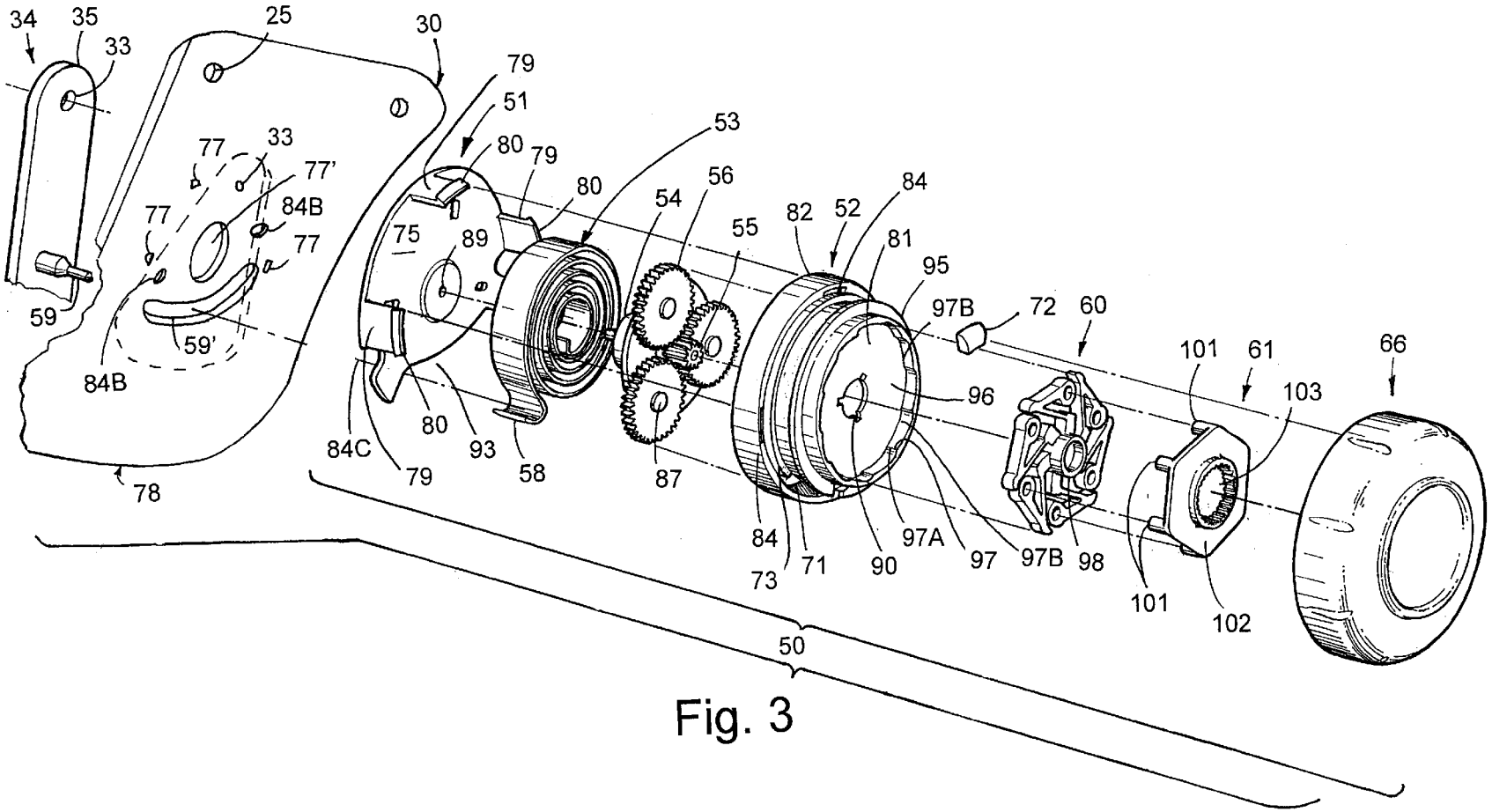
FIGS. 3 and 4 are inside-front and inside-rear exploded perspective views of the force adjusting device shown in FIG. 1.
Figures 4, 7A:
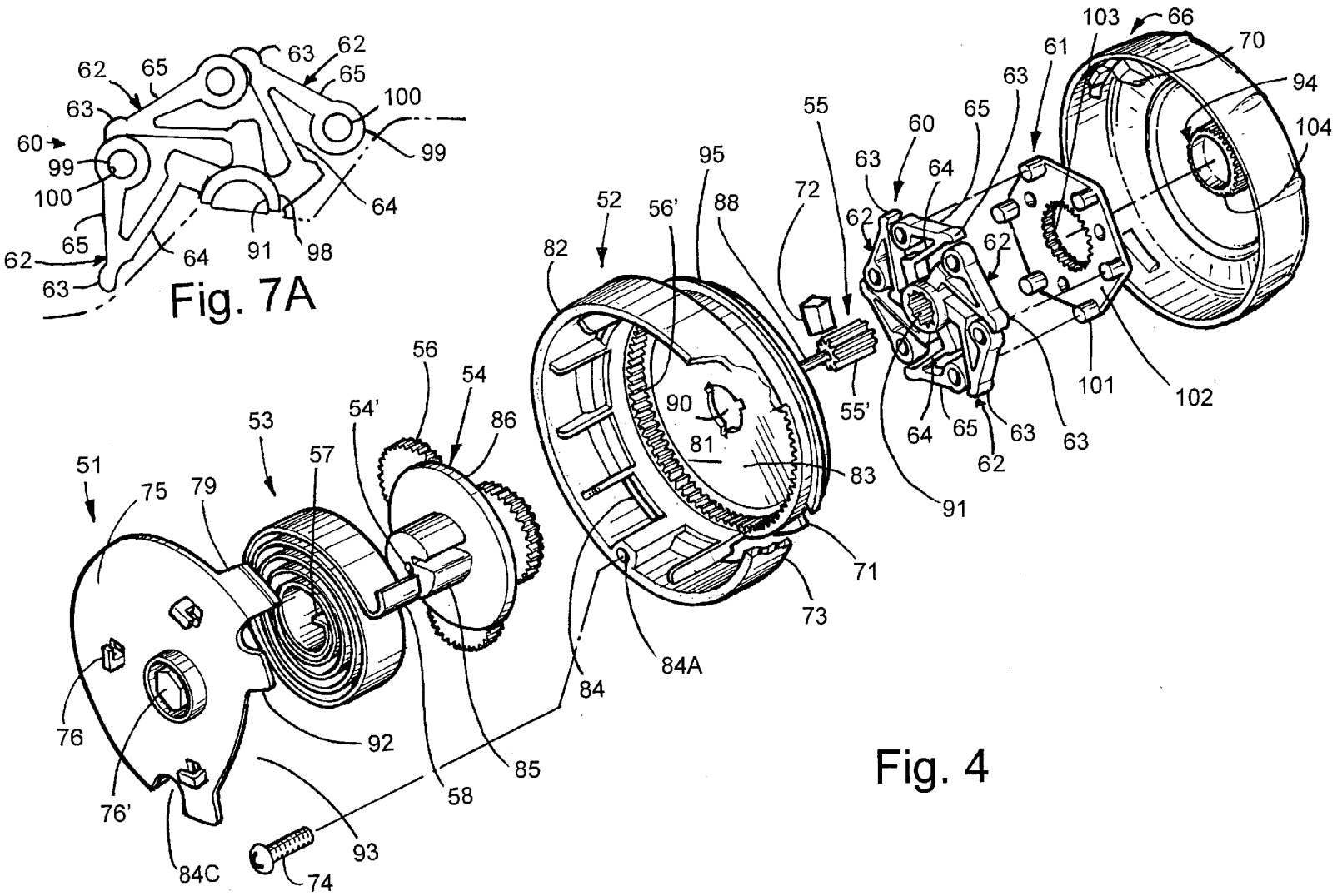
FIG. 7A is a view of half of the sprague clutch shown in FIG. 7, with half being removed to more easily identify parts of the clutch.
Figure 5:
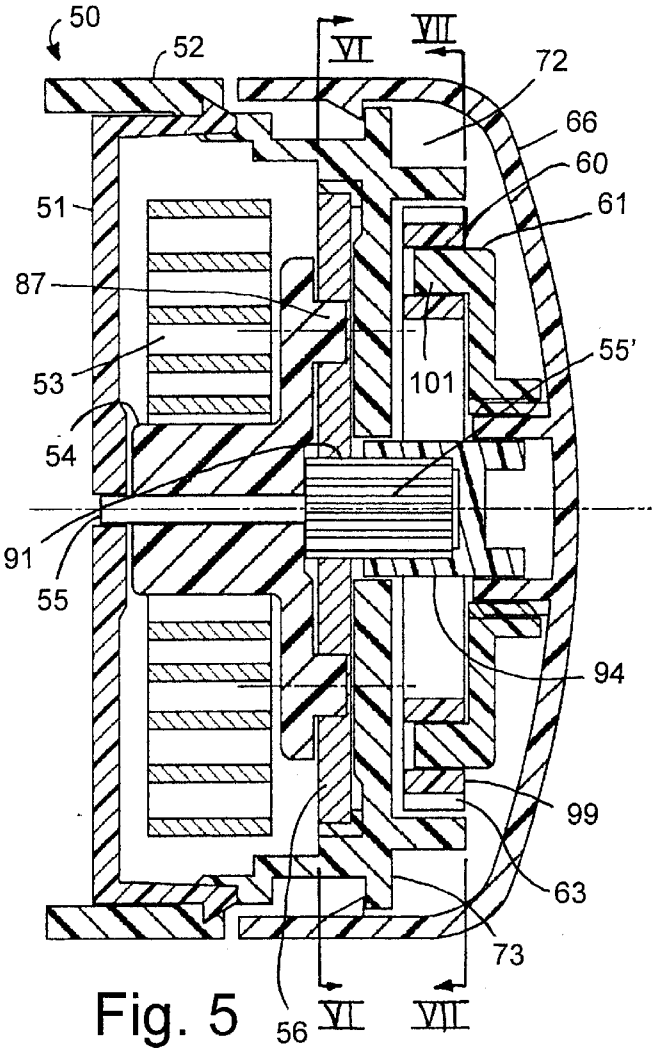
FIG. 5 is a cross-sectional view of the force adjusting device taken axially through the force adjusting device shown in FIG. 3.
Figure 6:
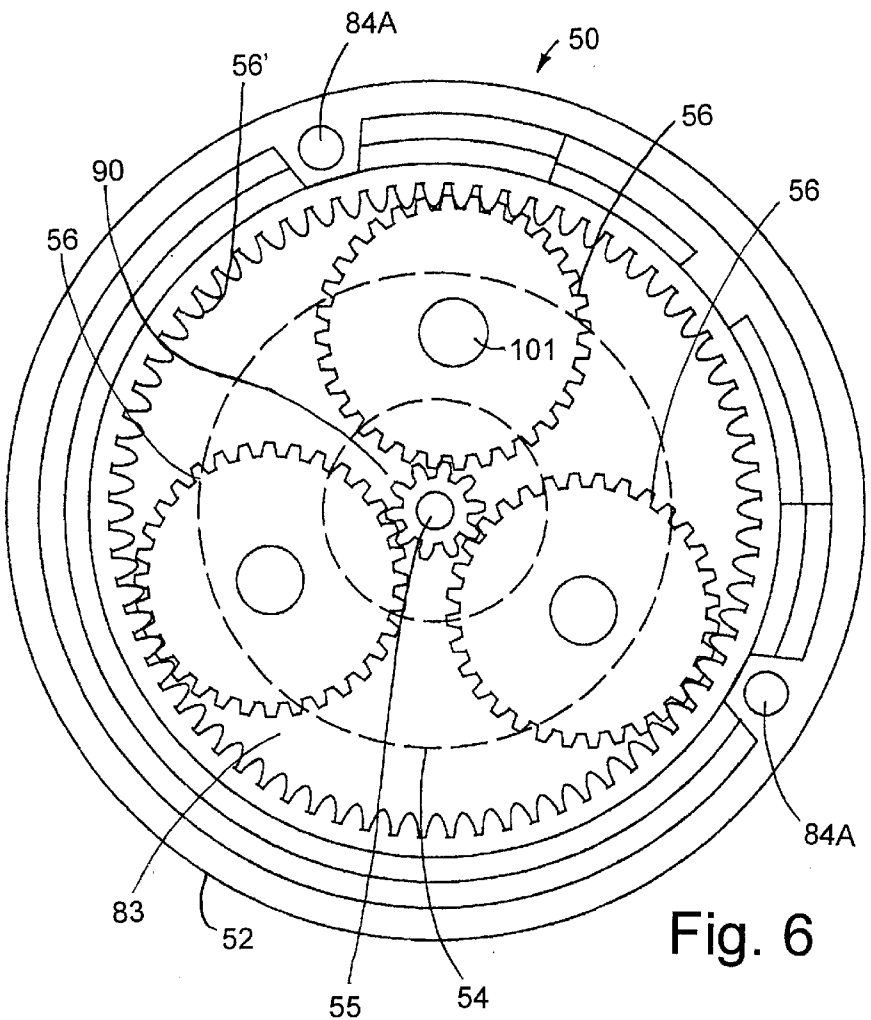
FIG. 6 is a cross-sectional view taken along the line VI—VI in FIG. 5.
Figure 8:
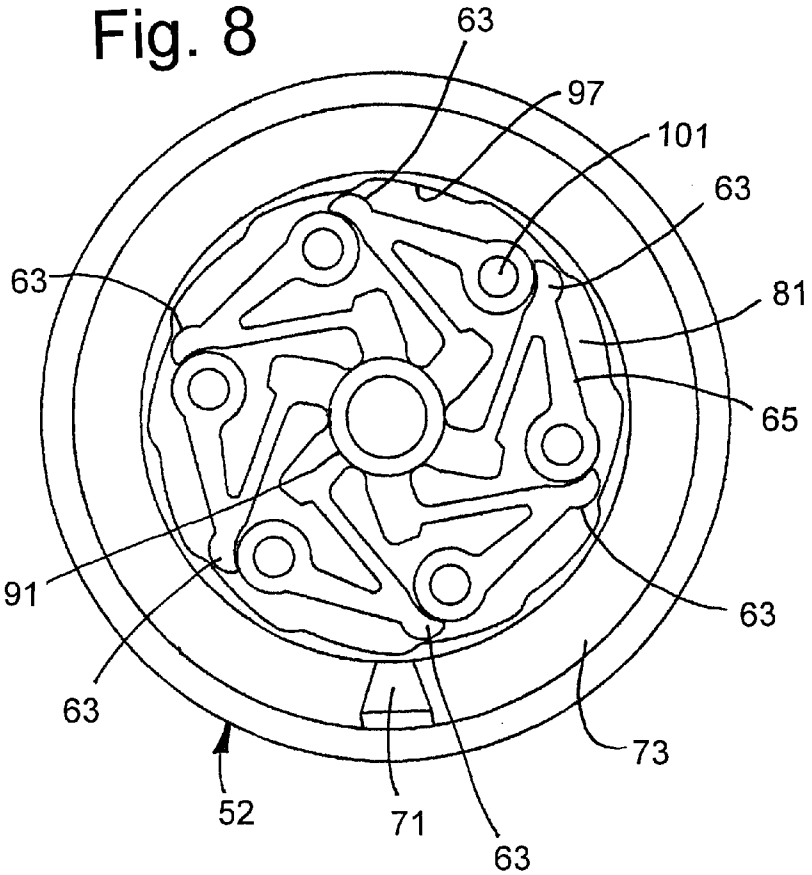
FIG. 8 is a view similar to FIG. 7, but with the sprague clutch shown in a released, rotatable position.
Figure 7:
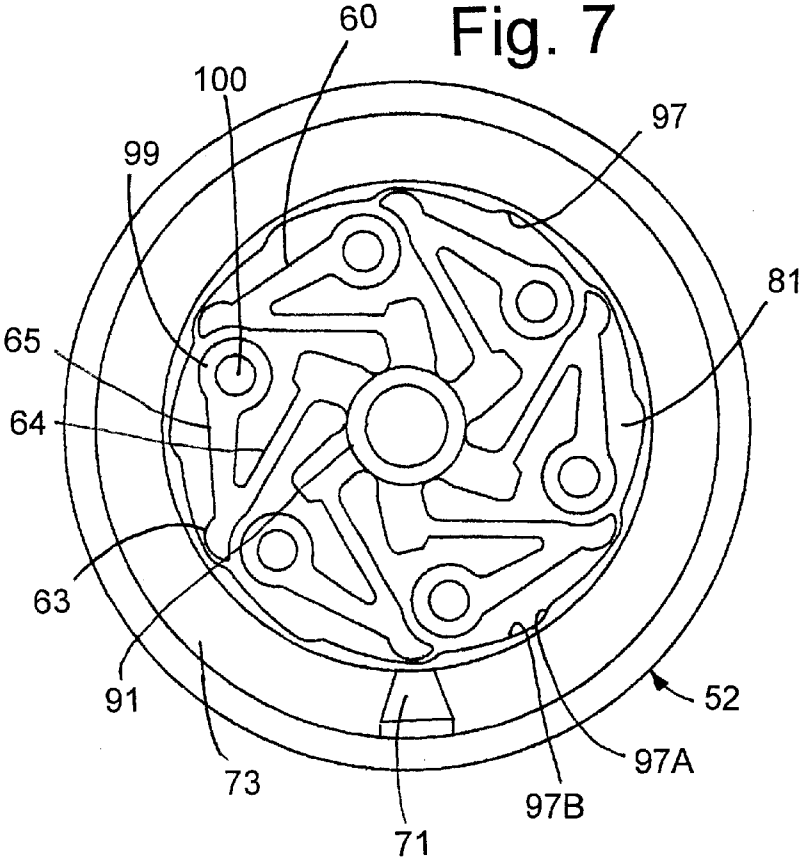
FIG. 7 is a cross-sectional view taken along the line VII—VII in FIG. 5, with the sprague clutch being in a locked position.

The lumbar force adjusting device 50 (FIG. 3) includes a housing 52 that attaches to a rigid component, e.g., the back frame 30 on the chair 20, and is configured to bias a movable component, e.g., the flange 35 of the belt bracket 34 on the chair 20, about the pivot 33. The housing 52 snappingly attaches to the base 51 and retains a torsional spiral spring 53, a spring hub 54, a sun gear 55, and planet gears 56 therebetween. The planet gears 56 engage a ring gear 56' (FIG. 4) inside a concavity of the housing 52. The spring 53, sometimes referred to as a "biasing member" herein, includes an inner end 57 that engages a slotted protrusion on the spring hub 54, and an outer end 58 that engages a protrusion 59 (FIG. 3) on the belt bracket flange 35. The protrusion 59 extends through an arcuate slot 59' in the back frame 30. The sun gear 55 extends through the housing 52 and engages a center of a sprague clutch 60. A drive ring 61 secured to knob 66 has protrusions that engage L-shaped legs 62 of the sprague clutch 60 at locations spaced from its center axis. The "elbow" 63 that joins inner and outer sections 64 and 65 of the L-shaped legs 62 operably engages detents in a recess on the top of the housing 52. The knob 66 and housing 52 aesthetically cover the arrangement and, in combination with housing 52, provide a compact package. The knob 66 and the drive ring 61 make up an adjuster that is operably connected to the gear arrangement 55/56/56' and to the clutch 60.

More specifically, the base 51 (FIG. 4) includes a panel body 75 with hook-shaped tabs 76 configured to fit into mating apertures 77 (FIG. 3) in the lower section 78 of the back frame 30. The hook-shaped tabs 76 are shaped to attach upon rotation of the base 51 to temporarily attach the force adjusting device 50 to the back frame 30. A hex-shaped projection 76' (FIG. 4) on base 51 extends into hole 77' (FIG. 3) in the lower section 78 and is configured to be turned by a socket wrench to assist with the assembly or disassembly. Attachment tabs 79 (FIG. 3) extend perpendicularly from panel body 75 and include barbs 80 on their ends. The panel body 75 defines an arcuate slot or space 93 for receiving the protrusion 59 on the belt bracket flange 35.

Figure 2:
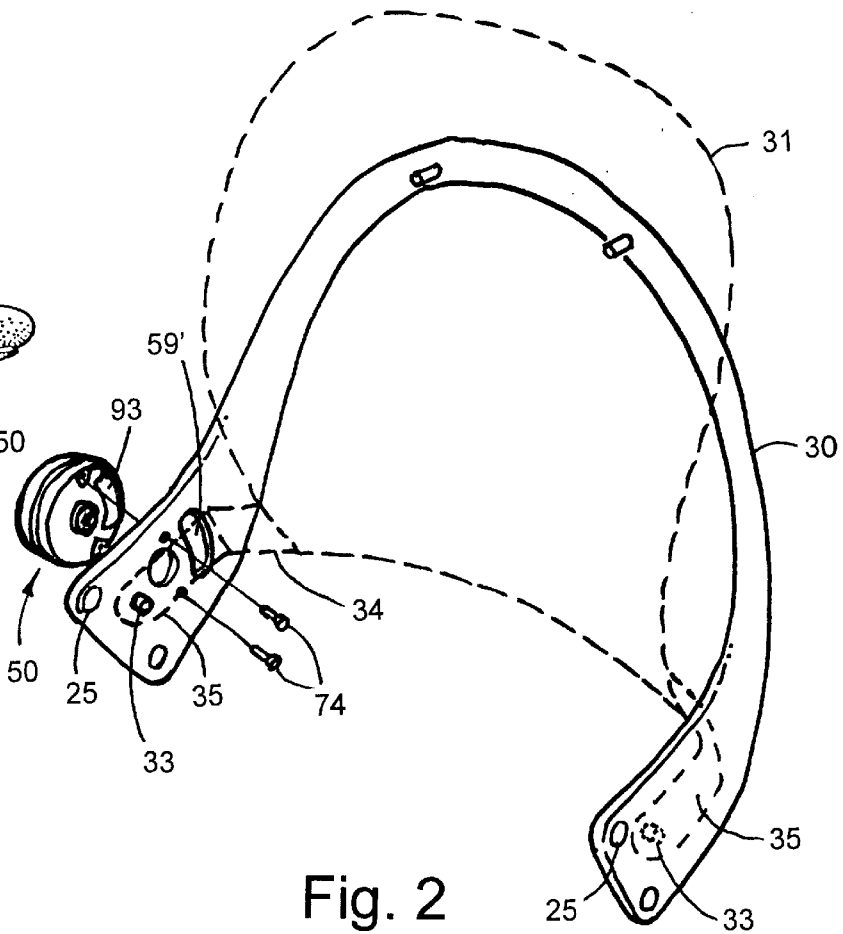
FIG. 2 is a front perspective view of the back frame shown in FIG. 1, the back support shell being shown in dashed lines, and the force adjusting device exploded away to better show the arrangement.

Housing 52 (FIG. 4) is cup shaped and includes a center panel 81 and an annular sidewall 82 extending in a first direction that define a spring-and-gear-storing cavity 83. The annular sidewall 82 includes apertures 84 for receiving and frictionally engaging the barbs 80 on the tabs 79. A pair of apertured bosses 84A (FIG. 4) are configured and arranged to receive screws 74 (FIG. 2) that extend through holes 84B in back frame 30. Spiral spring 53 includes a wound strip of steel that lies flat against the base 51. The spring-engaging hub 54 (FIG. 4) includes a center protrusion 85 with a slot for receiving the inner end 57 of the spring 53. The hub 54 further includes a washer 86 supporting a side of the planet gears 56, and three protruding studs or axles 87 (FIG. 3) for rotatably engaging the center holes in the planet gears 56. The sun gear 55 (FIG. 4) includes teeth 55' that engage the three planet gears 56, and includes a protruding rod 88 that extends through a hole 54' in the hub 54 into a hole 89 (FIG. 3) in the panel body 75. The teeth of sun gear 55 are extended, and extend through a center hole 90 in the center panel 81 and into engagement with a ribbed center hole 91 in the sprague clutch 60.

The housing 52 flrther includes an annular sidewall portion 95 that extends from sidewall 82 in a direction opposite the base 51 to define a clutch-storing cavity 96. An inner surface of the sidewall 95 includes detent undulations 97 that form 12 bumps, which is a multiple of the six legs 62 of the clutch 60. The depth of the clutch-storing cavity 96 is sufficient to receive the clutch 60 and a portion of the drive ring 61. The detent undulations 97 have an abruptly sloped side 97A and a more circumferential gently sloped side 97B. The abruptly sloped side 97A is shaped to lockup against the elbow 63 to hold spring 53 at a selected biasing force when torsional forces are applied and transmitted through center hub 98 and inner sections 64. The sloped sides 97A and 97B permit slippage and adjustment when torsional forces are transmitted from protrusions 101 to outer sections 65 of the clutch 60.

Specifically, the clutch 60 (FIG. 7A) includes a cylindrical hub 98 having the sun-gear-receiving center hole 91 therein. The inner sections 64 of the legs 62 of the clutch 60 extend from the hub 98 outwardly to the elbows 63, which elbows 63 engage the detent undulations 97. The outer sections 65 extend from the elbows 63 circumferentially but also radially inwardly, so that the outer ends 99 of the outer sections 65 are close to but spaced radially inward from the detent undulations 97. The outer ends 99 include holes 100 for receiving protrusions 101 on the drive ring 61. The drive ring 61 (FIG. 4) includes a panel body 102 that interconnects and supports the protrusions 101. A ribbed hole 103 in the panel body 102 of the drive ring 61 engages the ribbed outer surface 104 of a protrusion 94 on the knob 66.

The force adjusting device 50 operates as follows. The force multiplier including the gear arrangement is primarily located between or on housing 52 and base 51, while the clutch arrangement is located between or on handle knob 66 and housing 52. A biasing force in the spring 53 generates torque on the force adjusting device 50 for biasing the protrusion 59 of the belt bracket 34 toward a forward position where the lumbar section 29 protrudes forwardly. Also, when a person presses a lumbar portion of their lower back rearwardly in the chair 20, the protrusion 59 moves along slot 59' and additional torque is generated by the belt bracket flange 34' on the spring 53. The spring 53 is allowed to rotated within an angular rotation of about 90 degrees, as limited by the arcuate slot 59'. This lumbar-caused spring tension combines with biasing force in the spring 53 to torsionally bias the sun gear 55 that in turn applies a rotation force to the clutch 60. However, the clutch 60 does not slip because the torsional force of the spring 53 is communicated by the sun gear 55 to the clutch 60 at the clutch's center, which in turn is communicated by the inner section 64 of the legs 62 to the housing 52. The angle of the inner sections 64 to the depressions 67 in the housing 52 causes the clutch 60 to lock up, preventing unwanted rotation and "unwinding" of the spring 53. However, the force adjusting device 50 can be easily adjusted to increase or reduce pretension in the spring 53, because, when the knob 66 is rotated, a torsional force is applied through the drive ring 61 at locations spaced radially from a center of the clutch 60 at an angle that releases the clutch and lets the knob 66 rotate. Specifically, the adjusting force by the knob 66 is applied to the outer sections 65 of the legs 62. This adjusting force is applied at a different "flatter" angle, resulting in the clutch 60 allowing the clutch 60 and the sun gear 55 to rotate to selectively adjust the tension of the spring 53. The result is that the force adjusting device 50 can be easily adjusted in either direction by rotating the knob 66, yet the clutch withstands the torsional force generated by the spring 53 itself when in a selected position or by the spring in combination with torsional forces from movement of forwardly extending flanges 35 due to flexure of the lumbar section 29.

The knob 66 includes a first stop 70 (FIG. 4) and the housing, 52 includes a second stop 71 (FIG. 3) that slip past each other during rotation of the knob 66. However, an interference member 72 is shaped to ride along a shelf 73 on the sidewall 82 of housing 52 until it engages both stops 70 and 71. By this arrangement, the knob 66 can be turned rotationally almost two times completely around (i.e., about 700 degrees). The reason is because the interference member 72 engages adjacent sides of the stops 70 and 71, but then does not re-engage the other sides of the stops 70 and 71 until the knob 66 has been rotated almost completely around twice. This double rotation in combination with the gear arrangement of gears 55, 56, and 56' provides excellent mechanical advantage, making movement of the knob 66 to adjust a tension of the spring 53 relatively easy.

In the foregoing description, it will be readily appreciated by persons skilled in the art that modifications may be made to the invention without departing from the concepts disclosed herein. Such modifications are to be considered as included in the following claims, unless these claims by their language expressly state otherwise.

The invention claimed is:

1. A force adjusting device for adjusting a spring-generated biasing force on a movable component relative to a second component, comprising:

a housing adapted for attachment to the second component;

a spring operably mounted to the housing, the spring having a first end adapted to engage the movable component and having a second end;

a force multiplier arrangement operably engaging the second end and the housing, the force multiplier arrangement being configured to change a position of the second end with mechanical advantage to adjust a tension of the spring;

a handle for operating the force multiplier arrangement; and a clutch operably attached to the gear arrangement and the handle that is constructed to lock when a biasing force is received from the spring, but configured to release and allow movement of the handle and the force multiplier arrangement to adjust a tension of the spring when the handle is manipulated.

2. The force adjusting device defined in claim 1, wherein the force multiplier arrangement includes a gear arrangement operably connected between the housing and the handle.

3. The force adjusting device defined in claim 2, wherein the gear arrangement includes a first gear on the housing.

4. The force adjusting device defined in claim 3, wherein the gear arrangement includes planet gears engaging the first gear, and further includes a sun gear engaging the planet gears.

5. The force adjusting device defined in claim 4, wherein the handle is attached to the clutch at a center location.

6. The force adjusting device defined in claim 5, wherein the handle is attached to the clutch at second locations spaced radially from the center location.

7. The force adjusting device defined in claim 6, wherein the clutch includes a center hub attached to the sun gear and legs that extend from the center hub, the legs each including a first section that extends from the center hub into engagement with the housing, and a second section that extends from the first section to one of the second locations.

8. The force adjusting device defined in claim 4, wherein the sun gear is attached to the clutch at a center location.

9. The force adjusting device defined in claim 1, wherein the force multiplier arrangement includes planet gears engaging gear teeth on the housing, and further includes a sun gear engaging the planet gears.

10. The force adjusting device defined in claim 1, wherein the clutch includes a center hub connected to the force multiplier arrangement, and further includes legs with first sections that extend from the center hub into detented engagement with the housing and with second sections that extend to second locations spaced from the housing, and wherein the handle is attached to the second sections.

11. The force adjusting device defined in claim 1, wherein the handle comprises a cup-shaped knob that receives and covers one of the clutch and the force multiplier arrangement.

12. The force adjusting device defined in claim 1, wherein the housing comprises a cavity-defining shape that receives and covers at least one of the clutch and the force multiplier arrangement.

13. The force adjusting device defined in claim 1, wherein the housing includes a base configured to and adapted to engage the second component and to be secured thereto.

14. The force adjusting device defined in claim 1, wherein the housing, the force multiplier arrangement, the handle and the clutch are preassembled to form a unit adapted to be attached to the second component.

15. A force adjusting device for adjusting a spring-generated biasing force on a movable component relative to a second component, comprising:

a housing adapted for attachment to the second component;

a spring operably mounted to the housing, the spring having a first end adapted to engage the movable component and having a second end;

a hub engaging the second end that is configured to change a position of the second end to adjust a tension of the spring;

a handle for rotating the hub; and a clutch operably attached to the hub and the handle that is constructed to lock when a biasing force is received from the spring and the movable component, but configured to release and allow movement of the handle and the hub to adjust a tension of the spring when the handle is manipulated.

16. The force adjusting device defined in claim 15, wherein the clutch includes a center hub operably connected to the spring, and further includes legs with first sections that extend from the center hub into detented engagement with the housing and with second sections that extend from the first sections to second locations spaced from the housing, and wherein the handle is attached to the second sections.

17. The force adjusting device defined in claim 15, wherein the handle comprises a cup-shaped knob that receives and covers the clutch.

18. The force adjusting device defined in claim 15, wherein the housing comprises a cavity-defining shape that receives and covers a portion of the clutch.

19. The force adjusting device defined in claim 15, wherein the housing includes a base configured to and adapted to engage the second component and to be secured thereto.

20. The force adjusting device defined in claim 15, wherein the housing, the force multiplier arrangement, the handle and the clutch are preassembled to form a unit adapted to be attached toe the second component.

21. The force adjusting device defined in claim 15, including a gear arrangement interconnecting the spring to the clutch.

22. A force adjusting device for adjusting a spring-generated biasing force on a movable component relative to a second component, comprising:

a housing adapted for attachment to the second component, the housing including a ring gear;

a spring operably mounted to the housing, the spring having a first end adapted to engage the movable component and having a second end;

a gear arrangement engaging the second end and the ring gear that is configured to change a position of the second end with mechanical advantage to adjust a tension of the spring; and a handle operably attached to the gear arrangement for operating the gear arrangement, whereby the handle can be manipulated to operate the gear arrangement to adjust a tension of the spring.

23. The force adjusting device defined in claim 22, wherein the gear arrangement includes planet gears engaging the ring gear.

24. The force adjusting device defined in claim 23, wherein the gear arrangement includes a sun gear engaging the planet gears.

25. The force adjusting device defined in claim 24, including a clutch, and wherein the sun gear is attached to the clutch.

26. A chair comprising:

a back frame;

a flexible back support operably supported on the back frame, the flexible back support including a flexible lumbar region and a flanged bracket pivotally connected to the back frame at a back pivot; and a force adjusting device attached to the back frame at the back pivot for adjusting a spring-generated torsional biasing force on the flanged bracket relative to the back frame, the force adjusting device including:

a housing adapted for attachment to the back frame, the housing including a ring gear;

a spring operably mounted to the housing and adapted to generate the torsional biasing force, the spring having a first end constructed to engage the flanged bracket and having a second end;

a gear arrangement engaging the second end and the ring gear that is configured to change a position of the second end with mechanical advantage to adjust a tension of the spring;

a handle for operating the gear arrangement; and a clutch operably attached to the gear arrangement and the handle that is constructed to lock when a biasing force is received from the spring and the back support, but configured to release and allow movement of the handle and the gear arrangement to adjust a tension of the spring when the handle is manipulated.

27. A furniture unit comprising:

a first structural component;

a second structural component movably attached to the first structural component; and a force adjusting device including a biasing member biasing the second structural component relative to the first structural component, an adjuster configured to adjust the biasing member, and a clutch; the force adjusting device including a force multiplier to reduce a force required to move the adjuster, and the clutch being configured to release the adjuster to permit adjustment when operated by an operator, but that locks the biasing member in a selected position when the adjuster is not being operated by an operator.

* * * * *